US009771828B2

(12) United States Patent
Karafillis et al.

(10) Patent No.: US 9,771,828 B2
(45) Date of Patent: Sep. 26, 2017

(54) TURBINE EXHAUST FRAME AND METHOD OF VANE ASSEMBLY

(71) Applicant: General Electric Company, Schenectady, NY (US)

(72) Inventors: Apostolos Pavlos Karafillis, Winchester, MA (US); Martin Wayne Frash, Newburyport, MA (US); Schuyler Javier Ortega, Peabody, MA (US); Angelo Parisi, Nahant, MA (US)

(73) Assignee: General Electric Company, Schenectady, NY (US)

( * ) Notice: Subject to any disclaimer, the term of this patent is extended or adjusted under 35 U.S.C. 154(b) by 261 days.

(21) Appl. No.: 14/676,246

(22) Filed: Apr. 1, 2015

(65) Prior Publication Data

US 2016/0290168 A1 Oct. 6, 2016

(51) Int. Cl.
*F01D 9/04* (2006.01)
*F01D 25/24* (2006.01)
(Continued)

(52) U.S. Cl.
CPC ..... *F01D 25/246* (2013.01); *F01D 9/041* (2013.01); *F01D 9/042* (2013.01); *F01D 25/162* (2013.01); *F01D 25/30* (2013.01); *F05D 2220/32* (2013.01); *F05D 2230/60* (2013.01); *F05D 2240/121* (2013.01); *F05D 2240/14* (2013.01)

(58) Field of Classification Search
CPC ..... F01D 9/041; F01D 9/042; F01D 25/162; F01D 25/246; F01D 25/30; F05D 2220/32; F05D 2230/60; F05D 2240/121; F05D 2240/14
See application file for complete search history.

(56) References Cited

U.S. PATENT DOCUMENTS 94,162 A 8/1869 Wolf et al.
3,237,918 A 3/1966 Le Bell et al.
(Continued)

FOREIGN PATENT DOCUMENTS

CN 101153546 A 4/2008
CN 103195573 A 7/2013
(Continued)

OTHER PUBLICATIONS

A European Search Report issued in connection with corresponding Application No. 16162943.1 on Jul. 25, 2016.
(Continued)

*Primary Examiner* — Igor Kershteyn
(74) *Attorney, Agent, or Firm* — General Electric Company; William Scott Andes

(57) ABSTRACT

A turbine frame for a turbine engine having an axial centerline, includes an inner hub, an outer hub encircling the inner hub, a plurality of struts extending between the inner and outer hubs, at least one vane segment comprising at least first and second fairings mounted to the inner and outer hubs and encircling one of the struts and a single piece outer retaining ring that is operably coupled to the vane segment to fix a radial position of the vane segment relative to the inner and outer retaining rings and methods of assembling at least one vane segment having at least one vane formed from a pair of fairings to an exhaust frame.

20 Claims, 13 Drawing Sheets

(51) Int. Cl.
*F01D 25/30* (2006.01)
*F01D 25/16* (2006.01)

(56) References Cited

U.S. PATENT DOCUMENTS

| | | | | |
|---|---|---|---|---|
| 4,793,770 | A * | 12/1988 | Schonewald | F01D 9/04 415/142 |
| 4,897,020 | A | 1/1990 | Tonks | |
| 4,993,918 | A | 2/1991 | Myers et al. | |
| 5,020,318 | A | 6/1991 | Vdoviak | |
| 5,332,357 | A | 7/1994 | Tubbs | |
| 5,357,744 | A * | 10/1994 | Czachor | F01D 9/065 415/134 |
| 5,634,767 | A * | 6/1997 | Dawson | F01D 25/246 415/134 |
| 5,931,636 | A | 8/1999 | Savage et al. | |
| 5,941,537 | A | 8/1999 | Wallace et al. | |
| 6,439,841 | B1 * | 8/2002 | Bosel | F01D 9/065 415/142 |
| 6,672,833 | B2 * | 1/2004 | MacLean | F23R 3/60 415/116 |
| 6,983,608 | B2 | 1/2006 | Allen, Jr. et al. | |
| 2003/0161716 | A1 | 8/2003 | Nguyen et al. | |
| 2004/0088989 | A1 | 5/2004 | Dowman | |
| 2010/0104432 | A1 | 4/2010 | Hasselqvist et al. | |
| 2010/0132374 | A1 | 6/2010 | Manteiga et al. | |
| 2010/0135777 | A1 | 6/2010 | Manteiga et al. | |
| 2010/0303608 | A1 | 12/2010 | Kataoka et al. | |
| 2011/0302929 | A1 | 12/2011 | Bruehwiler | |
| 2013/0167552 | A1 | 7/2013 | Keny et al. | |
| 2013/0336782 | A1 | 12/2013 | Ryczek et al. | |
| 2014/0178187 | A1 | 6/2014 | Sakekar et al. | |
| 2014/0352313 | A1 | 12/2014 | Schott et al. | |
| 2016/0290168 | A1 * | 10/2016 | Karafillis | F01D 9/041 |

FOREIGN PATENT DOCUMENTS

| | | | |
|---|---|---|---|
| JP | 2005180418 | A | 7/2005 |
| JP | 2015524533 | A | 8/2015 |
| NO | 2014022358 | A1 | 2/2014 |
| WO | 2014197037 | A2 | 12/2014 |

OTHER PUBLICATIONS

A European Search Report issued in connection with corresponding Application No. 16163348.2 on Jul. 25, 2016.
A US Non-Final Rejection issued in connection with related U.S. Appl. No. 14/676,385 on Feb. 17, 2017.
Unofficial English Translation of Chinese Office Action issued in connection with related CN Application No. 201610198591.7 on Mar. 3, 2017.
GE Related Case Form, Apr. 7, 2017.
Japanese Search Report issued in connection with corresponding JP Application No. 2016-062961 dated Mar. 28, 2017.
Office Action issued in connection with corresponding JP Application No. 2016-062961 dated on Apr. 4, 2017.

* cited by examiner

TURBINE EXHAUST FRAME AND METHOD OF VANE ASSEMBLY

BACKGROUND OF THE INVENTION

Turbine engines, and particularly gas or combustion turbine engines, are rotary engines that extract energy from a flow of combusted gases passing through the engine onto a multitude of turbine blades. Gas turbine engines typically include a stationary turbine exhaust frame that provides a mounting structure for the turbine vanes and a structural load path from bearings that support the rotating shafts of the engine to an outer casing of the engine. The turbine frame is exposed to high temperatures in operation and it is desirable to increase operating temperatures within gas turbine engines as much as possible to increase both output and efficiency.

To protect struts of the turbine frame from the high temperatures, a one-piece wraparound fairing can be used. This configuration requires the struts be separable from the frame assembly at the hub, outer ring or both to permit fairing installation over the struts. This makes installation and field maintenance difficult. A split fairing arrangement in which forward and aft sections are sandwiched around the struts can be used but relies on an interlocking feature to keep the fairing halves together after assembly to the frame. This interlocking feature consumes a significant amount of physical space and is therefore less desirable for use with many frame configurations as it increases aerodynamic blockage. Further, such structures require structural frames that are constructed using a separable hub, which increases part counts and weight.

BRIEF DESCRIPTION OF THE INVENTION

In one aspect, an embodiment of the invention relates to a method of assembling at least one vane segment having at least one vane formed from a pair of fairings to an exhaust frame having an inner hub and an outer hub, which are connected by at least one strut, the method includes attaching together the vane segment with only one of the fairings to an inner retaining ring such that the vane segment may radially move relative to the inner retaining ring, positioning the exhaust frame relative to the assembled vane segment and the inner retaining ring such that the strut is at least partially encircled by the one of the fairings, reducing the combined radial dimension of the vane segment and the inner retaining ring by relatively radially moving the vane segment and the inner retaining ring, positioning an outer retaining ring about the vane segment and the inner retaining ring, increasing the combined radial dimension of the vane segment and the retaining by relatively radially moving the vane segment and the inner retaining ring, and attaching the outer retaining ring to the vane segment to fix the radial position of the vane segment relative to the inner and outer retaining rings.

In another aspect, an embodiment of the invention relates to a turbine frame for a turbine engine having an axial centerline, the turbine frame comprising, an inner hub, an outer hub encircling the inner hub, a plurality of struts extending between the inner and outer hubs, at least one vane segment comprising at least first and second fairings mounted to the inner and outer hubs and encircling one of the struts, an inner retaining ring that is operably coupled to the vane segment; and a single piece outer retaining ring that is operably coupled to the vane segment to fix a radial position of the vane segment relative to the inner and outer retaining rings wherein the vane segment may radially move relative to the inner retaining ring until the single piece outer retaining ring is operably coupled to the vane segment.

DESCRIPTION OF EMBODIMENTS OF THE INVENTION

Figure 1:
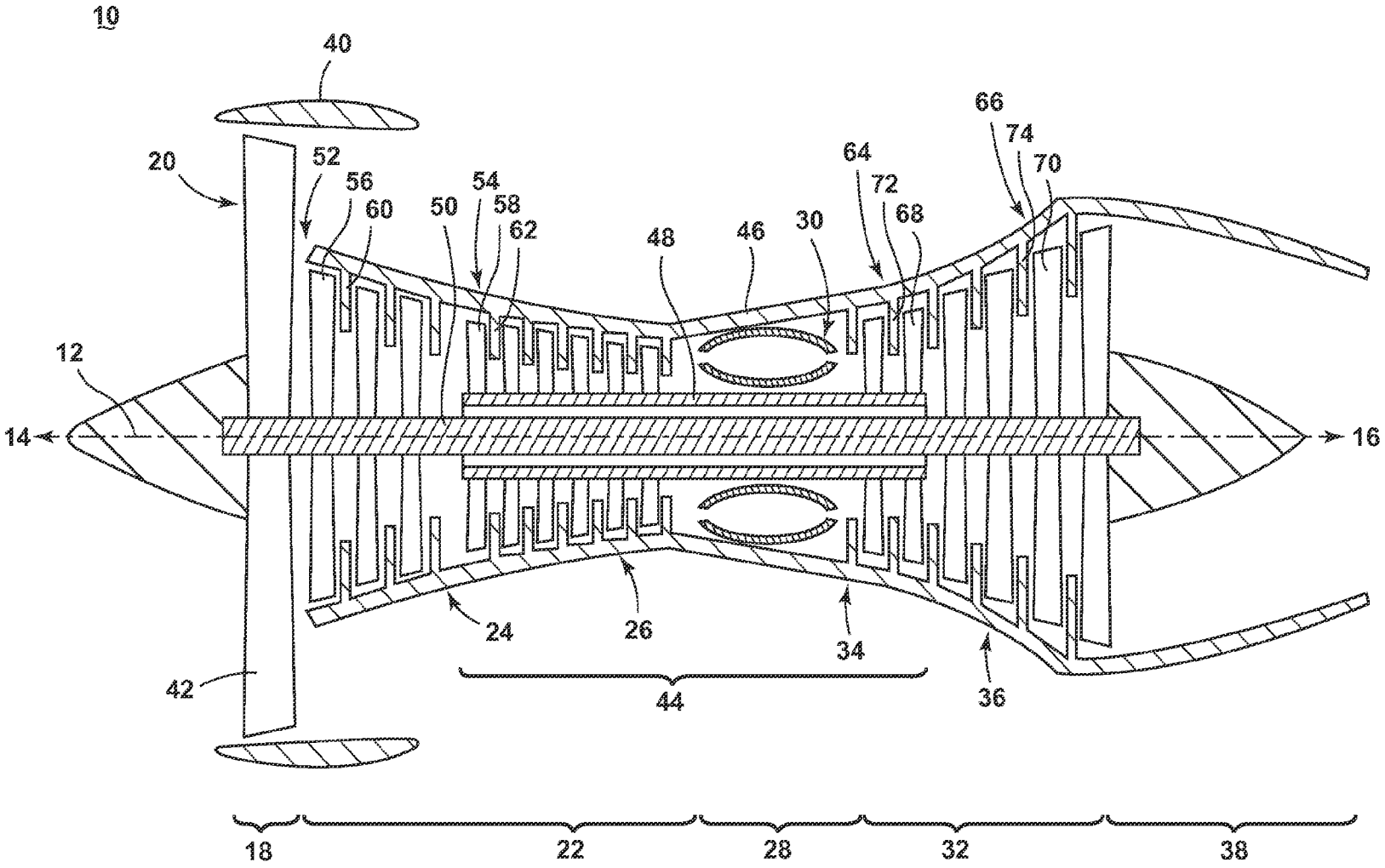
FIG. 1 is a schematic cross-sectional diagram of a gas turbine engine for an aircraft.

Embodiments of the invention relate to a turbine exhaust frame for a gas turbine engine. For purposes of explaining the environment of embodiments of the invention, FIG. 1 illustrates an exemplary gas turbine engine 10 for an aircraft forming an environment for the turbine exhaust frame. It will be understood that the principles described herein are equally applicable to turboprop, turbojet, and turbofan engines, as well as turbine engines used for other vehicles or in stationary applications. The engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12.

The HP compressor 26, the combustor 30, and the HP turbine 34 form a core 44 of the engine 10 which generates combustion gases. The core 44 is surrounded by a core casing 46, which can be coupled with the fan casing 40. A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 may be provided in a ring and may extend radially outwardly relative to the centerline 12, from a blade platform to a blade tip, while the corresponding static compressor vanes 60, 62 are positioned downstream of and adjacent to the rotating blades 56, 58. It is noted that the number of blades, vanes, and compressor stages shown in FIG. 1 were selected for illustrative purposes only, and that other numbers are possible.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 may be provided in a ring and may extend radially outwardly relative to the centerline 12, from a blade platform to a blade tip, while the corresponding static turbine vanes 72, 74 are positioned upstream of and adjacent to the rotating blades 68, 70.

In operation, the rotating fan 20 supplies ambient air to the LP compressor 24, which then supplies pressurized ambient air to the HP compressor 26, which further pressurizes the ambient air. The pressurized air from the HP compressor 26 is mixed with fuel in combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

Some of the ambient air supplied by the fan 20 may bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid may be, but is not limited to, fluid discharged from the LP compressor 24 or the HP compressor 26.

Figure 2:
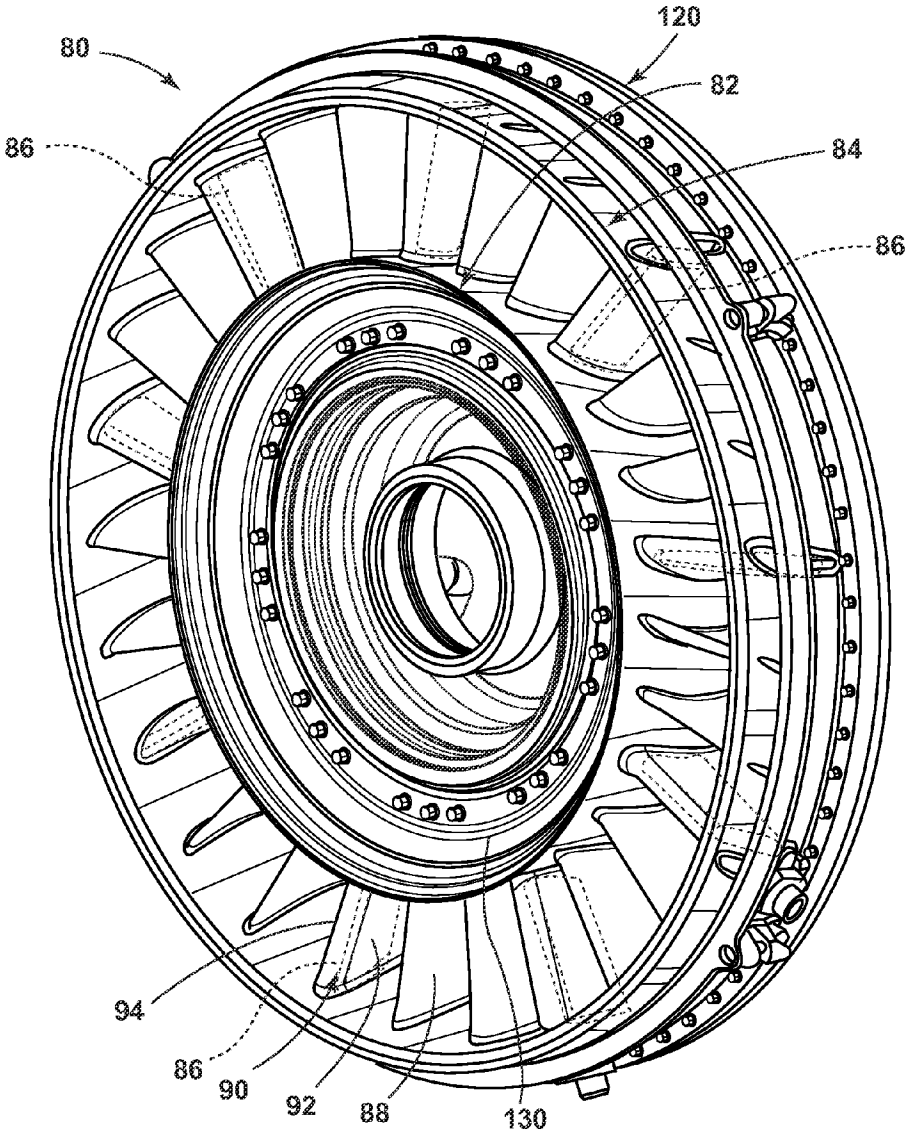
FIG. 2 is a perspective view of a turbine exhaust frame of the engine from FIG. 1.

FIG. 2 illustrates the structural details of an exhaust frame 80 supporting the LP/HP turbine vanes 72, 74 of FIG. 1. So as not to limit, which section of the turbine the exhaust frame 80 may be utilized in, the vanes have been given alternative numerals. It will be understood however that if the exhaust frame was for the high pressure turbine, then it would correspond to turbine vanes 72 and if the exhaust frame was for the low pressure turbine, then the vanes of the exhaust frame would correspond to the low pressure vanes 74.

The exhaust frame 80 may provide a structural load path from bearings, which support the rotating shafts 48, 50 of the engine 10 to an outer casing 40 of the engine 10. The exhaust frame 80 crosses the combustion gas flow path of the turbine section 32 and is thus exposed to high temperatures in operation. An inner hub 82, an outer hub 84 encircling the inner hub 82, and a plurality of struts 86 (shown in phantom) extending between the inner hub 82 and the outer hub 84 may be included in the exhaust frame 80. Some of the struts 86 may contain service lines or conduits 83 (FIG. 3) within their interior.

Figure 3:
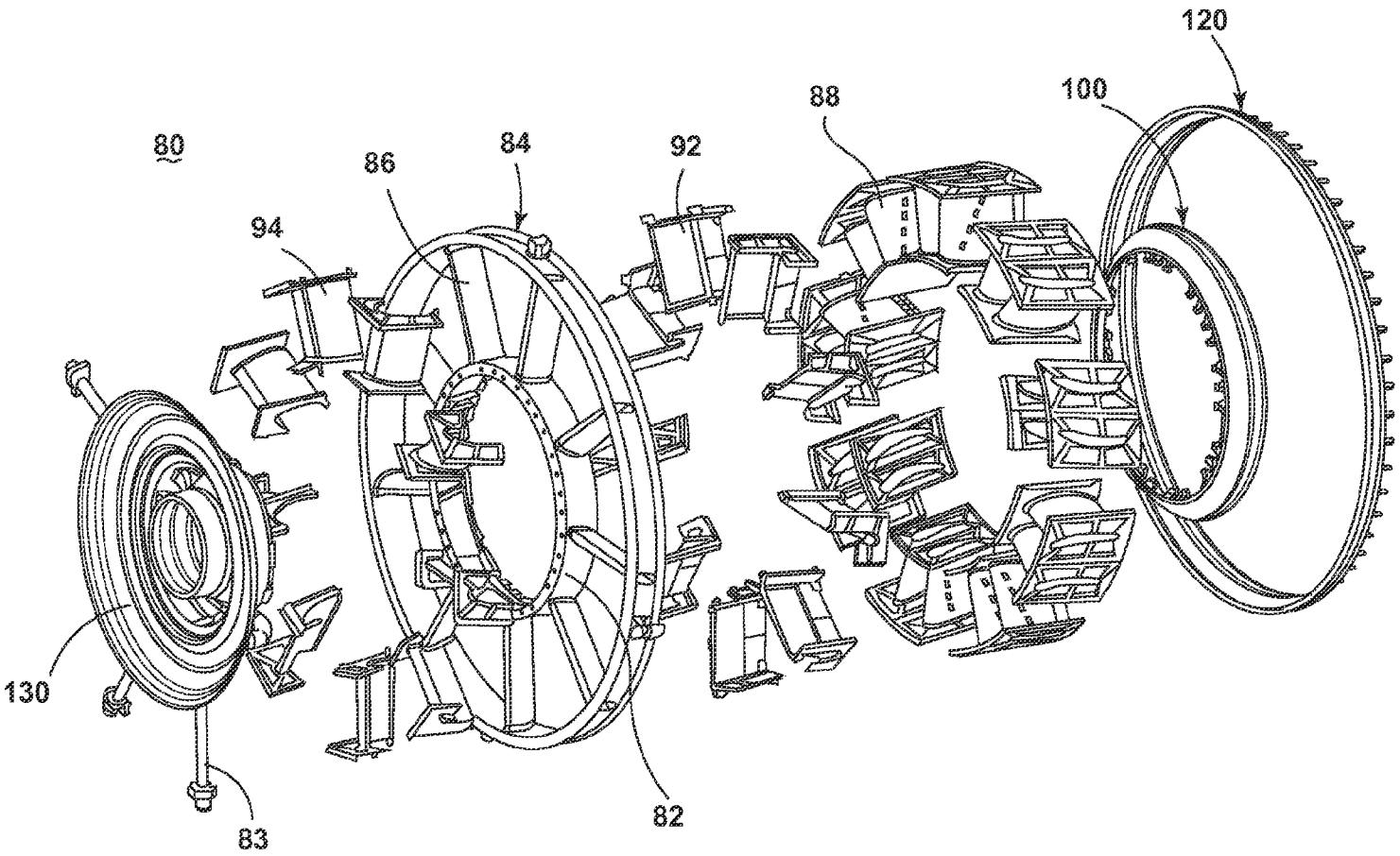
FIG. 3 is an exploded view of the turbine exhaust frame of FIG. 2.

There may be any number of vanes 88 and 90 included in the exhaust frame 80. The vanes 88 and 90 may have airfoil shapes and may create an airfoil cascade. During operation, the vanes 88 and 90 shape the air flow to improve the engine efficiency. The struts 86, which are not an airfoil shape, would negatively impact the airflow; therefore, the vanes 90 are included to form an airfoil around the struts 86. It will be understood that in the illustrated example the vanes 90 surround structural elements, like the struts 86 while the vanes 88 surround nothing. FIG. 3 illustrates an exploded view of the exhaust frame 80 to illustrate this more clearly. The vanes 90, surrounding the struts 86, may be formed by a pair of fairings 92 and 94. The first and second fairings 92 and 94 may connect together along first and second join lines 93 and 95 (FIG. 9) to define an interior sized to receive one of the struts 86.

The exploded view of FIG. 3 also more clearly illustrates that the exhaust frame may include an inner retaining ring 100 and an outer retaining ring 120. The assembly of the exhaust frame 80 has historically been very complex and required the use of multi-piece structures, especially a multi-piece outer retaining ring. Embodiments of the invention include an assembly method, which allows for use of a one piece outer retaining ring 120, which results in a simpler and faster assembly, and a reduced part count. FIGS. 4-13 sequentially illustrate the major steps for the assembly method.

Figure 4:
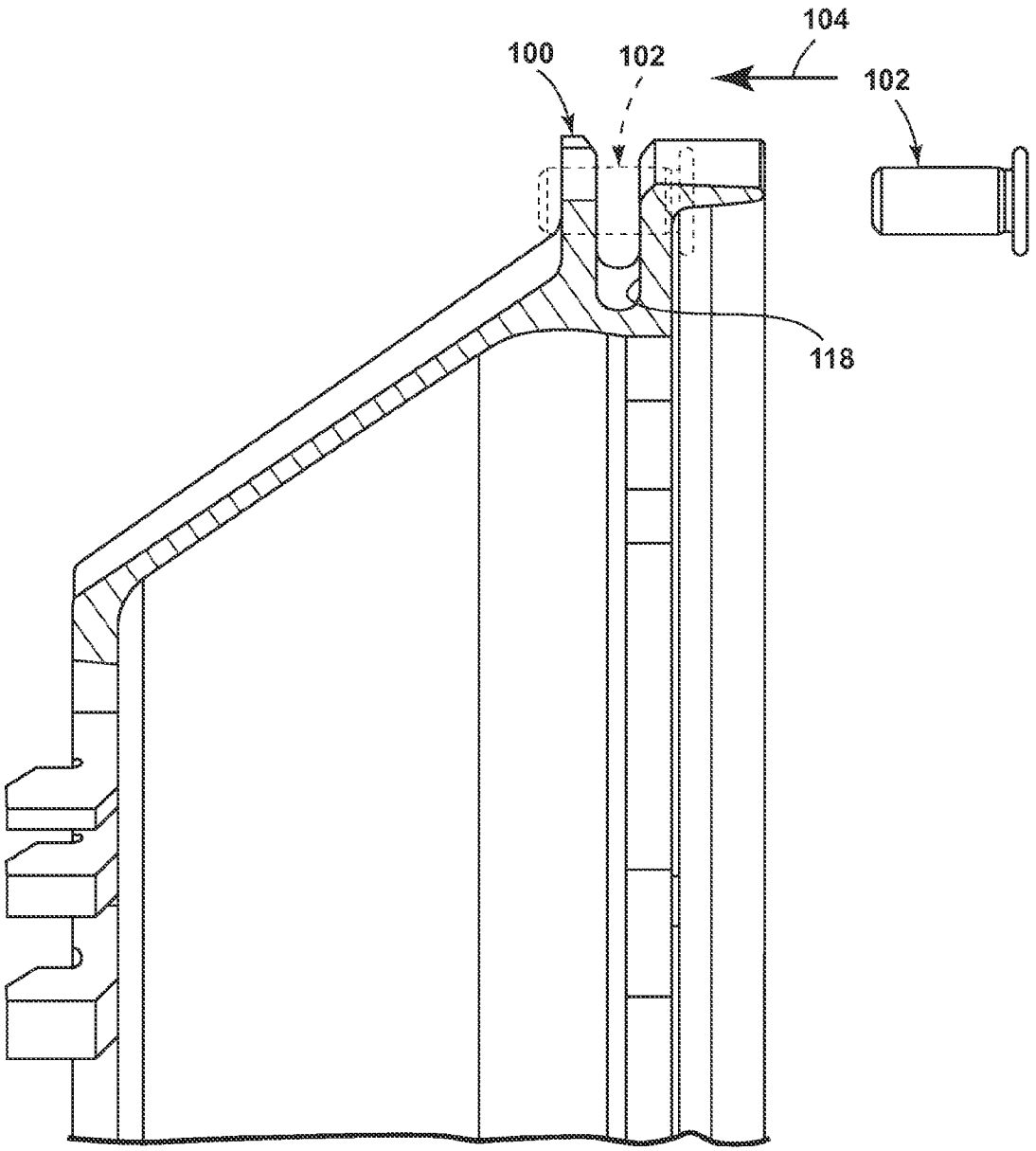
FIG. 4 is a side view of a pin being inserted into a partial sectional view of a retainer of the exhaust frame of FIG. 2.

Referring to FIG. 4, to begin the assembly of the exhaust frame 80; an alignment pin 102 is inserted into the inner retaining ring 100 in the direction indicated by arrow 104. The alignment pin 102 extends between portions of the inner retaining ring 100 such that it overlies a channel 118 in inner retaining ring 100. It will be understood that only a partial, sectional portion of the inner retainer ring 100 has been illustrated for clarity purposes. The alignment pin 102 may be a D-head pin installed into the inner retainer ring 100 and tack welded in to place. While only one alignment pin 102 is illustrated, it will be understood that multiple alignment pins 102 may be located radially around the inner retaining ring 100.

Figure 5:
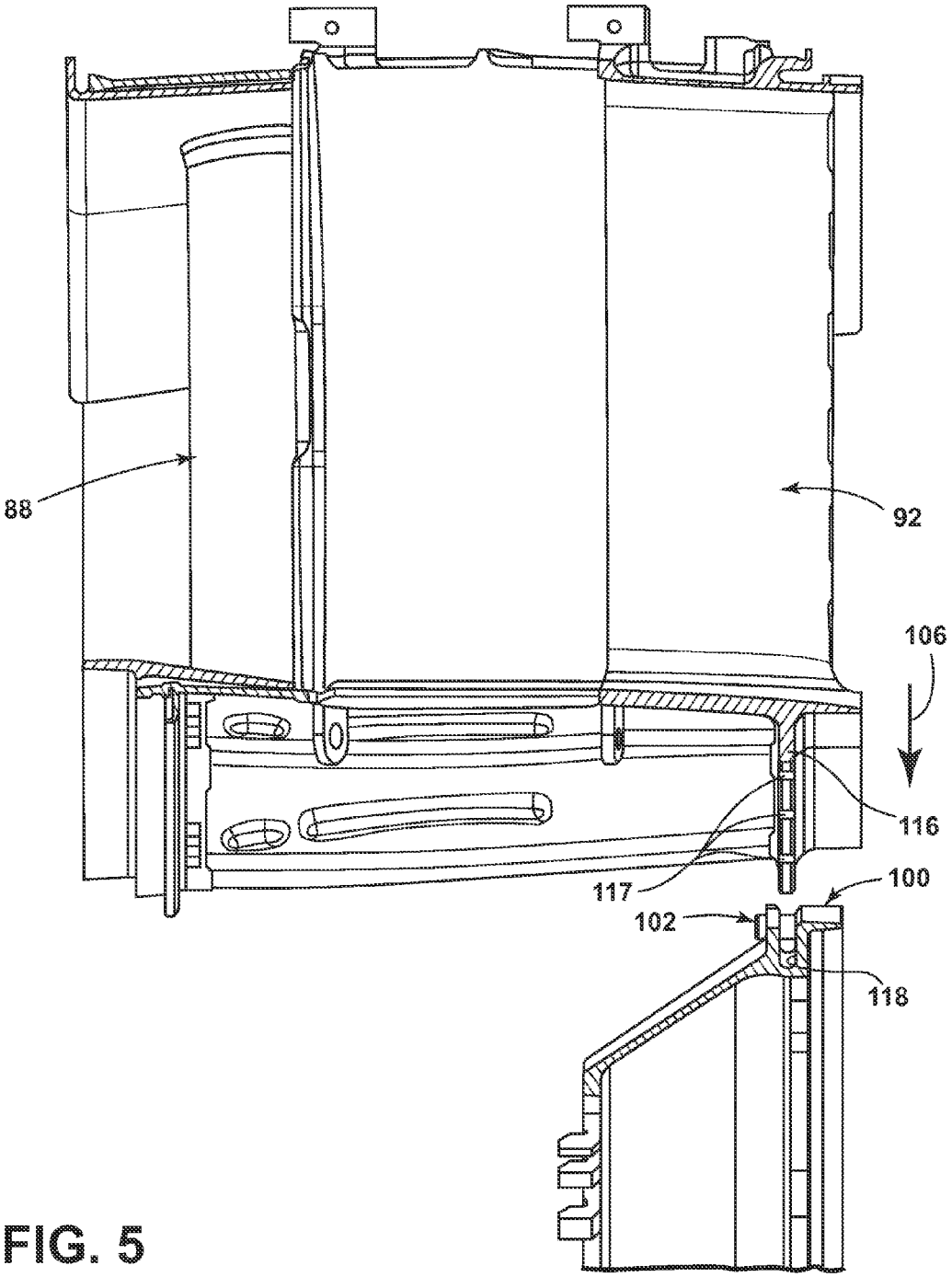
FIG. 5 is a side view of vanes and a first portion of a fairing being inserted in the retainer of FIG. 4.

Referring to FIG. 5, after the assembly of the pin 102 to the inner retaining ring 100, a vane segment, which may include two vanes 88 and a first fairing 92 of a vane 90 being inserted in the portion of the inner retainer ring 100 in the direction of arrow 106. The segment of the vane 90 may be attached to the inner retainer ring 100 in such a manner that the segment of the vane 90 may radially move relative to the inner retaining ring 100. More specifically, a flange 116 of the first fairing 92 is received within the channel 118 of the inner retaining ring 100. Notches 117 may be included in the flange 116 to aid in locating the first fairing 92 in the channel 118 relative to the alignment pin(s) 102.

Figure 6:
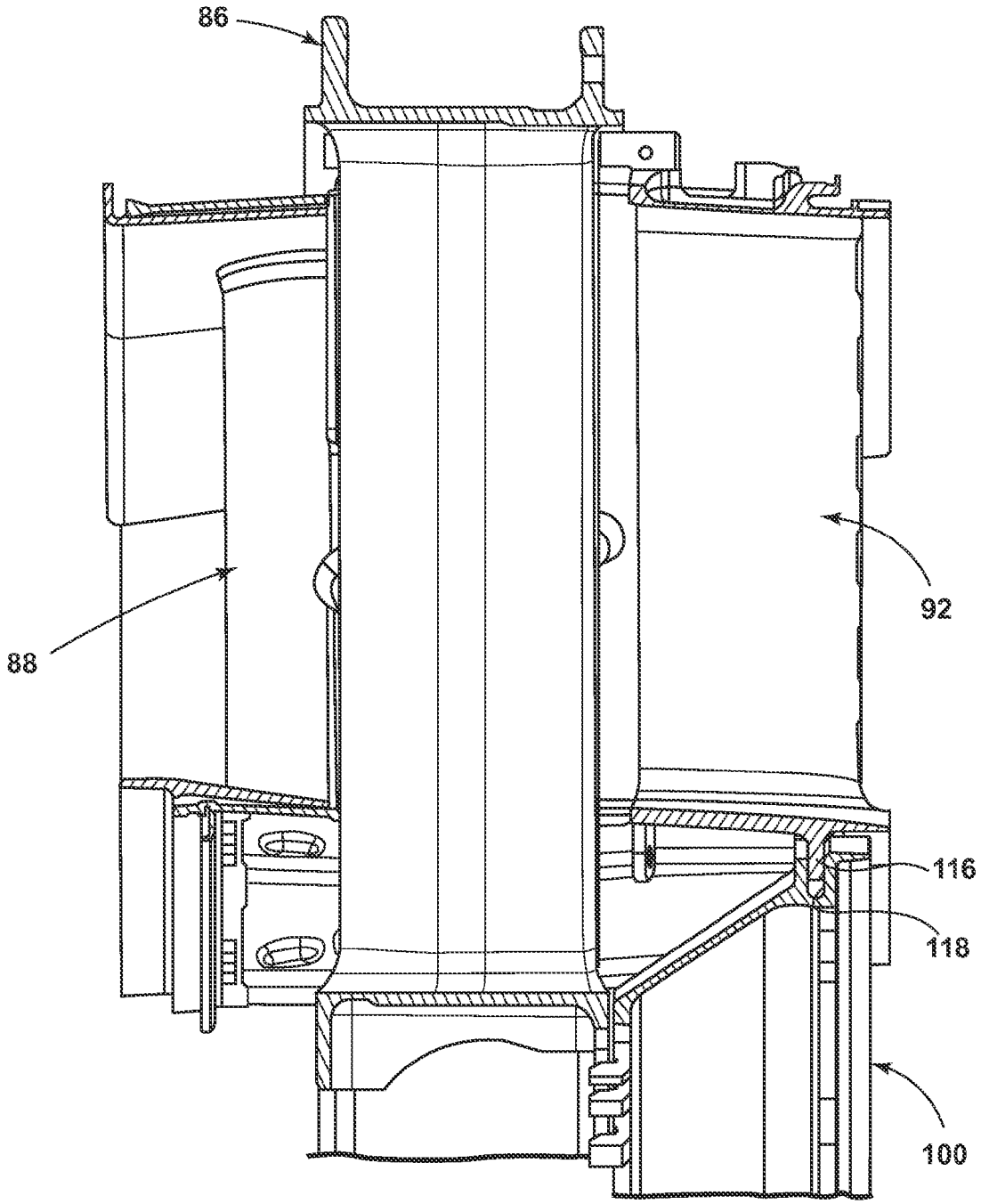
FIG. 6 is a side view of the retainer, vane, and fairing assembly being positioned around a strut of the exhaust frame of FIG. 2.

Next, as shown in FIG. 6, the exhaust frame 80 including one of the struts 86 is positioned relative to the assembly of the vane segment, first fairing 92, and the inner retaining ring 100 such that the strut 86 is at least partially encircled by the first fairing 92. More specifically, the exhaust frame 80 may be axially moved relative to the assembly until the strut 86 is at least partially encircled by the first fairing 92. In the illustrated example of FIG. 6 the exhaust frame 80 is moved until the strut 86 is positioned such that the first fairing 92 encircles a back portion of the strut 86.

Figure 7:
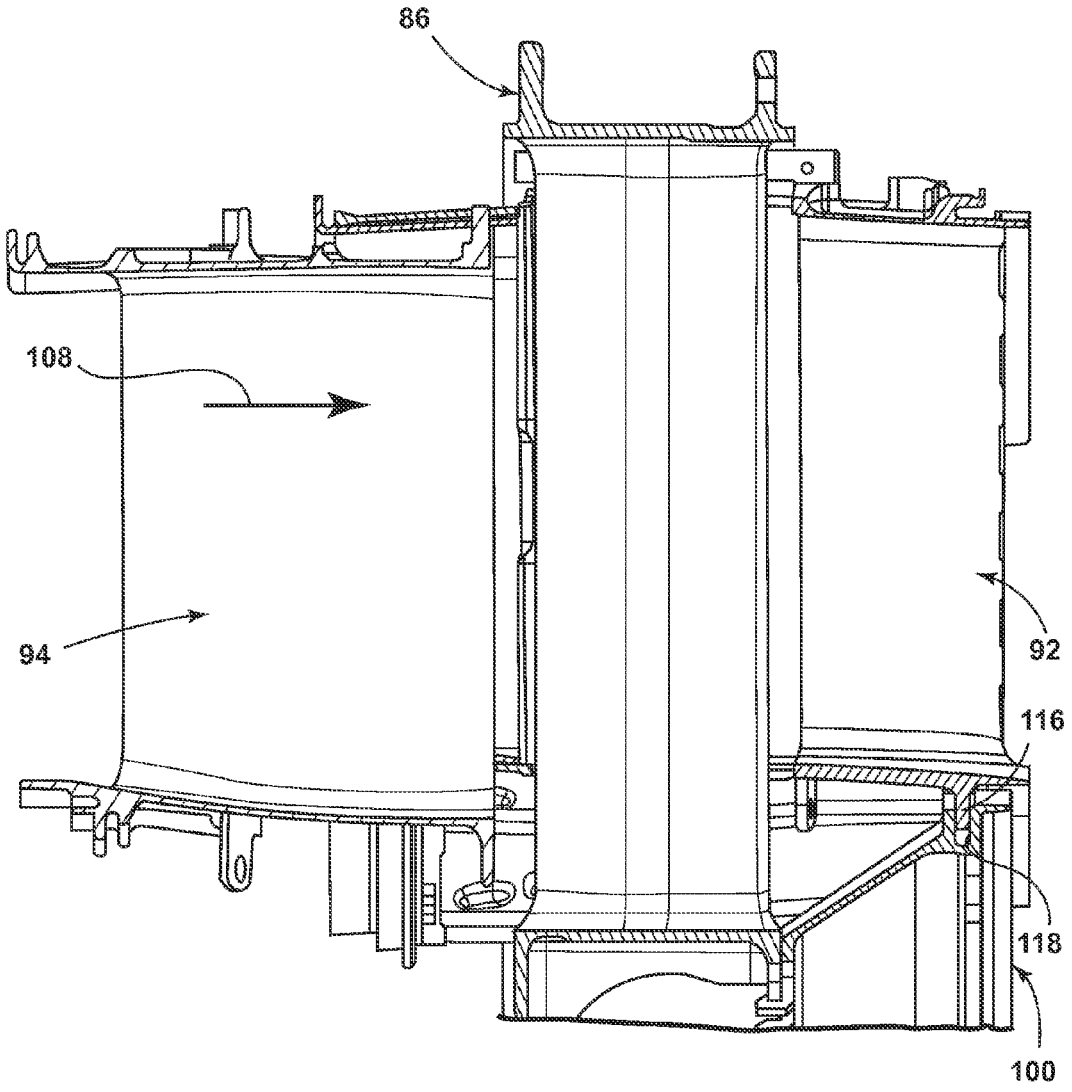
FIG. 7 is a side view of a second portion of the fairing being positioned around the strut of the exhaust frame of FIG. 2.
Figure 8:
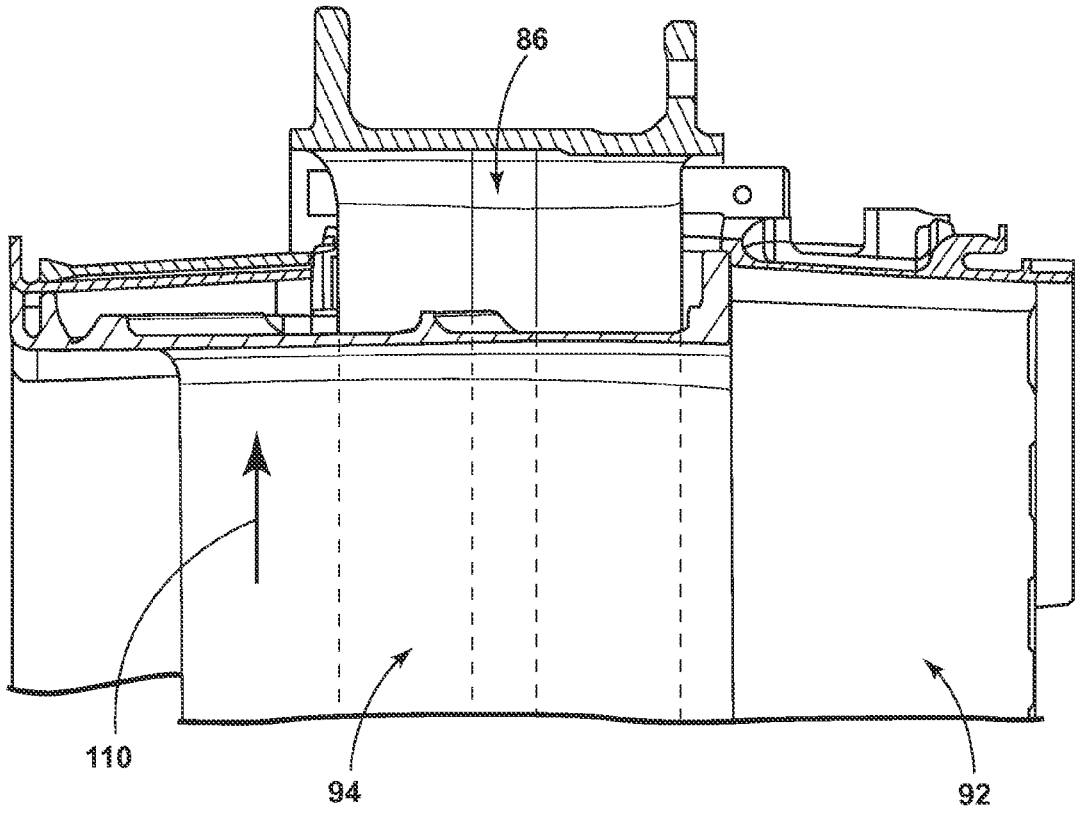
FIG. 8 is a side view of the second portion of the fairing being moved upwards.
Figure 9:
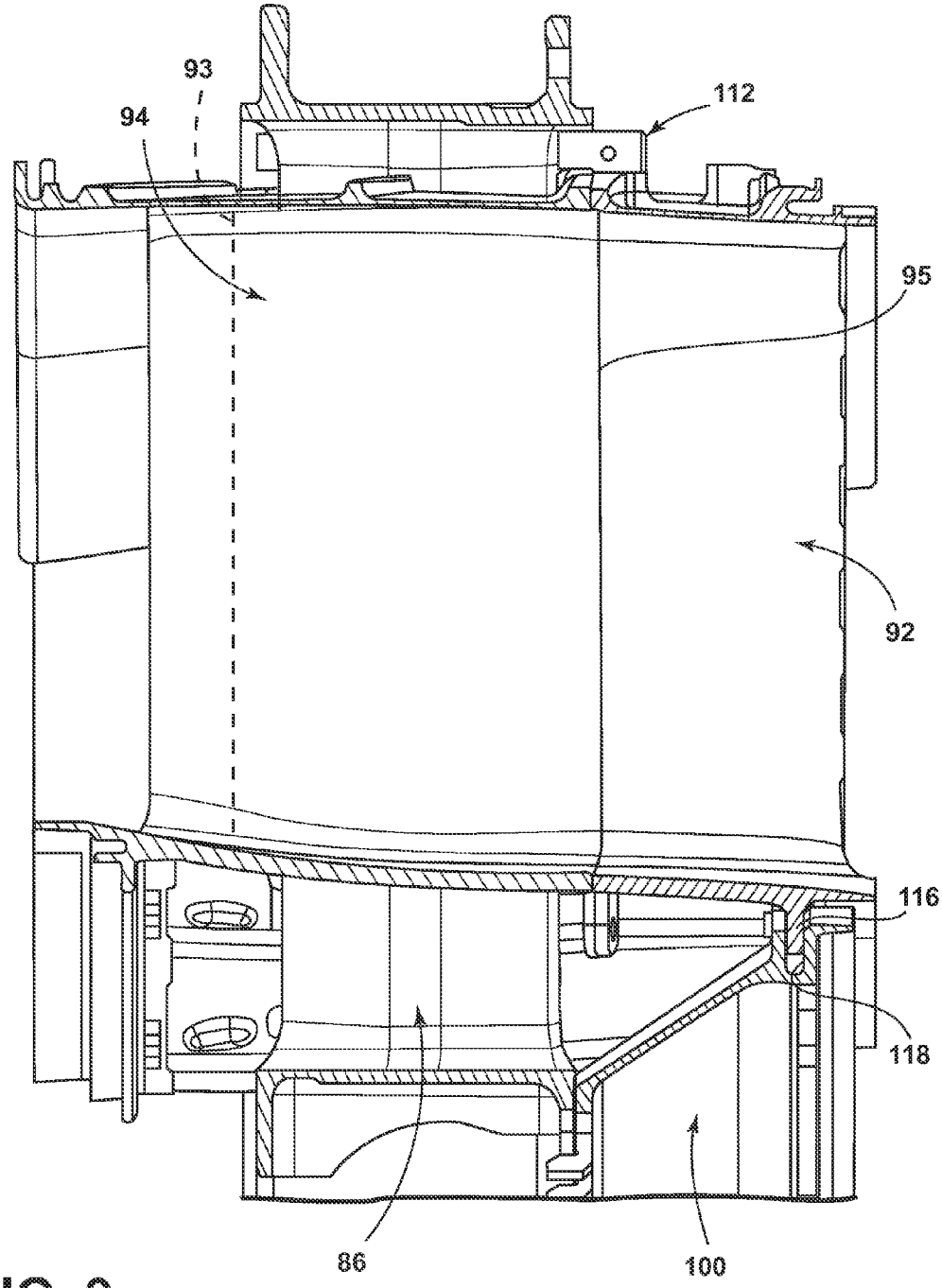
FIG. 9 is a side view of the second portion of the fairing engaged with a retainer.

FIG. 7 illustrates that the second fairing 94 may be brought into position around a front portion of the strut 86. More specifically the second fairing 94 may be moved axially in the direction of the arrow 108. The second fairing 94 may be positioned about the strut 86 such that the first and second fairings 92 and 94 completely encircle the strut 86, which is seen in FIG. 8. In this manner, positioning the second fairing 94 may include axially moving the second fairing 94 adjacent the first fairing 92. As is further illustrated in FIG. 8, positioning the second fairing 94 may also include radially moving the second fairing 94 radially outward. The second fairing 94 may be moved in the direction of the arrow 110 until it engages a retainer 112 as illustrated in FIG. 9. The retainer 112 may be any suitable retainer including a pin and buckle retainer.

Figure 10A:
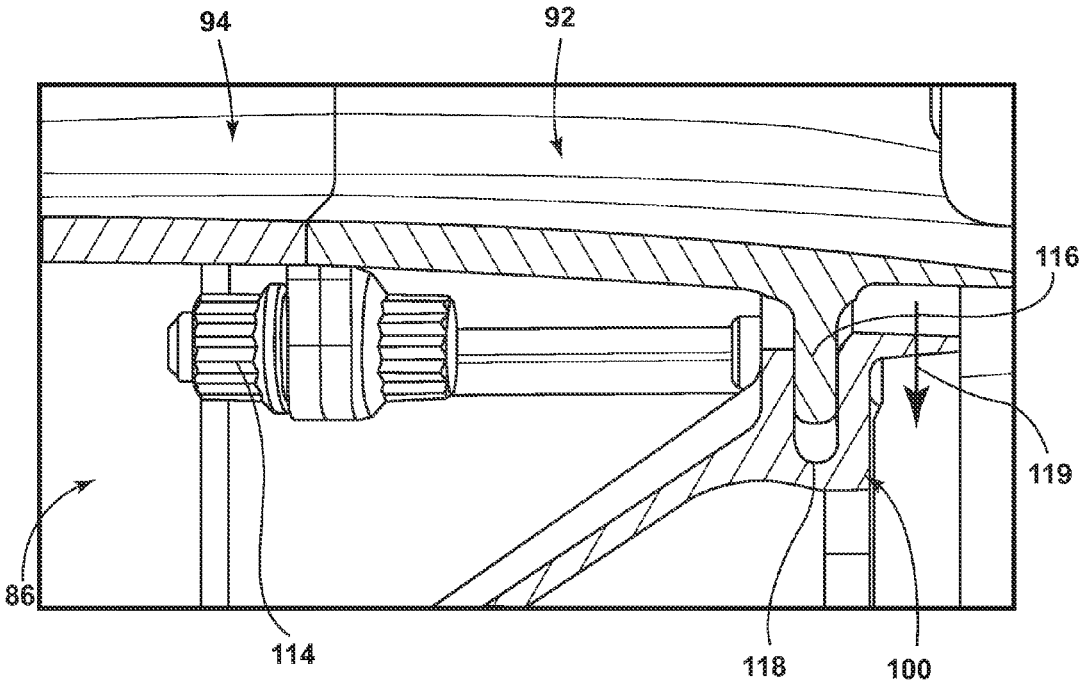
FIG. 10A is a cross-sectional view illustrating a portion of the fairing assembly within a portion of the retainer of FIG. 4.
Figure 10B:
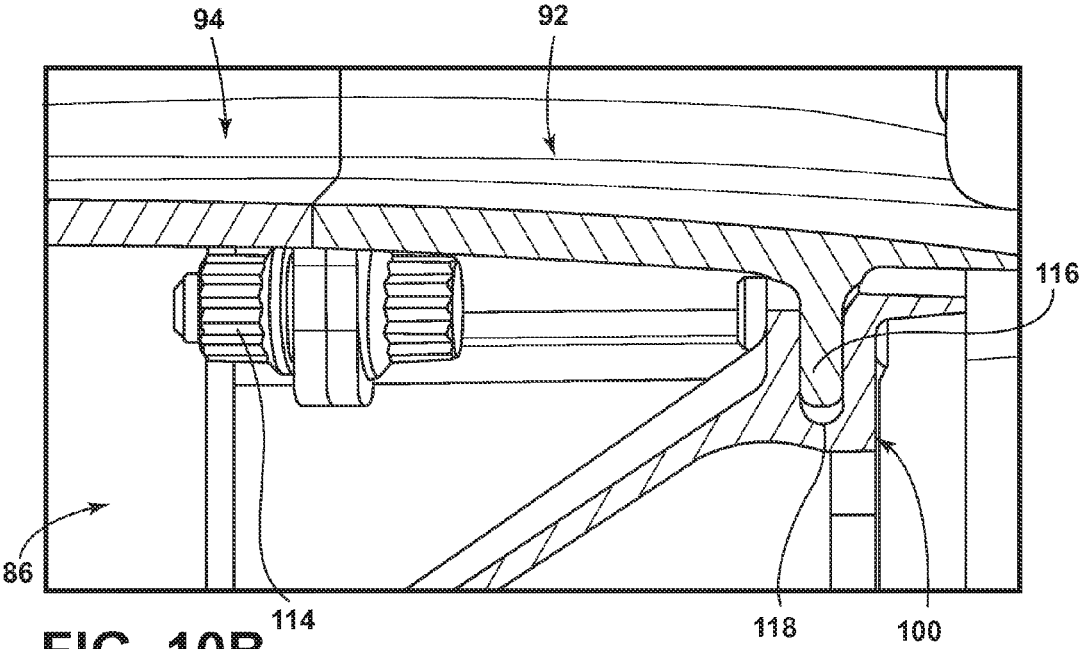
FIG. 10B is a cross-sectional view illustrating the portion of the fairing assembly moved radially inward within the portion of the retainer.

The first and second fairings 92 and 94 may be secured together in any suitable manner including that they may be bolted together via a bolt 114 as illustrated in FIG. 10A. FIG. 10A also more clearly shows that the segment of the vane 90 may be attached to the inner retainer ring 100 in such a manner that the segment of the vane 90 may radially move relative to the inner retaining ring 100. For example, the combined radial dimension of the vane segment 90 including the first and second fairings 92 and 94 and the inner retaining ring 100 may be reduced by relatively radially moving the vane segment 90 and the inner retaining ring 100. More specifically, the flange 116 of the first fairing 92 may be moved further into the channel 118 of the inner retaining ring 100 in the direction of the arrow 119. FIG. 10B illustrates that the flange 116 has been moved radially inwardly into the channel 118 at which point any flow path gaps there between may be closed.

Figure 11:
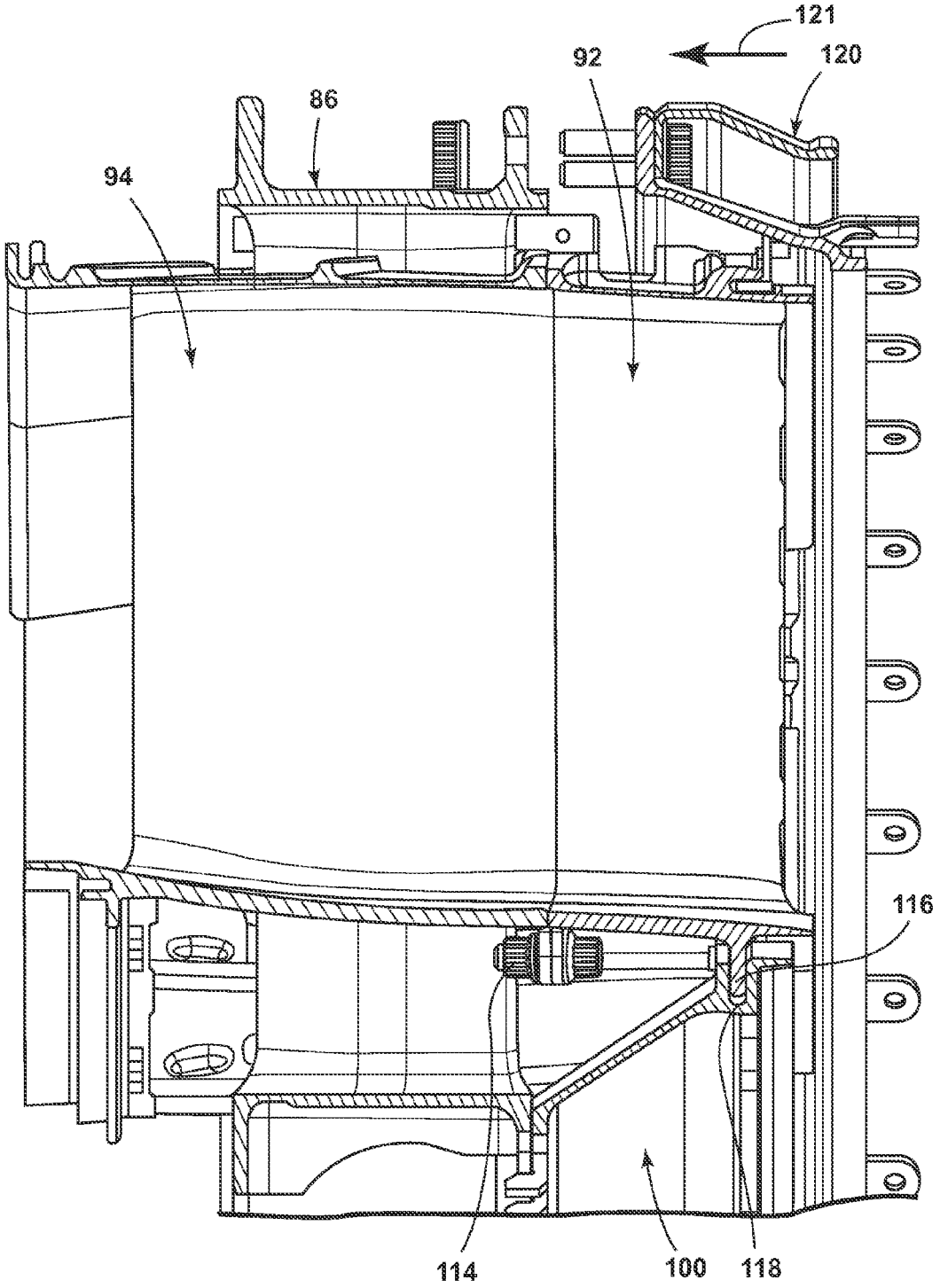
FIG. 11 is a side view of a cutaway portion of an outer retaining ring being moved over the retainer, vane, and fairing assembly.

FIG. 11 illustrates an outer retaining ring 120 being positioned about the assembly including the vane segment 90 formed from the first and second fairings 92 and 94 and the inner retaining ring 100. As illustrated, the outer retaining ring 120 is moved in the direction of the arrow 121. Positioning the outer retaining ring 120 may include axially moving the outer retaining ring 120 over at least a portion of the vane segment 90. In the illustrated example, a portion of the outer retaining ring 120 is over a portion of the first faring 92 as may be more clearly seen in FIG. 12A. As illustrated, the outer retaining ring 120 is a hanger. However, it is contemplated that a structure other than the hanger may be used for the outer retaining ring 120.

Figure 12A:
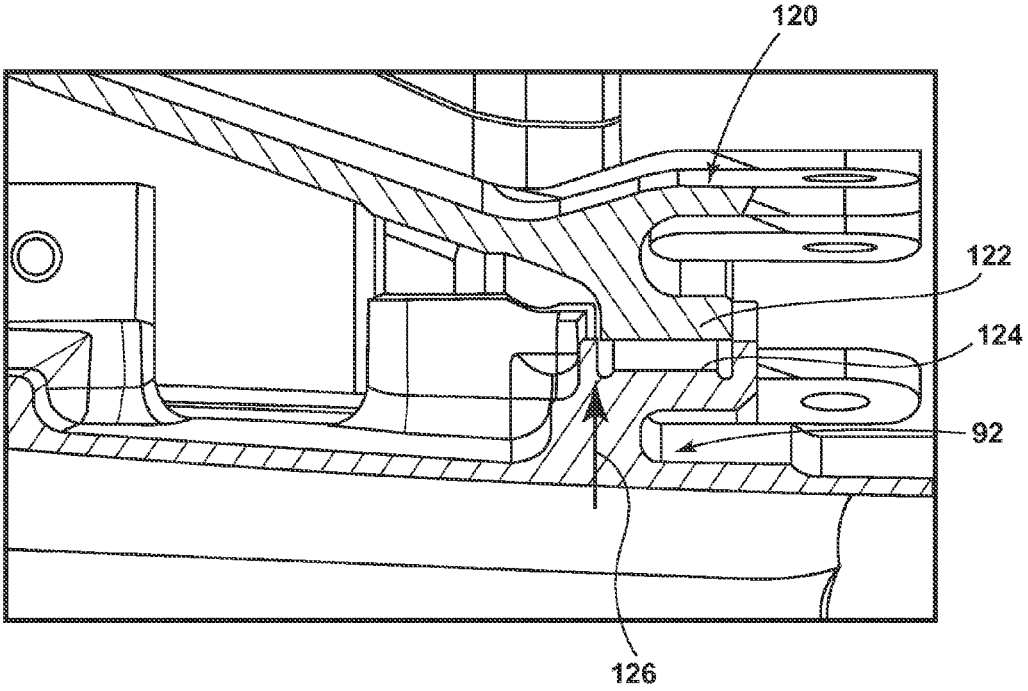
FIG. 12A is a cross-sectional view of a portion of the outer retaining ring being moved into a portion of the fairing assembly.
Figure 12B:
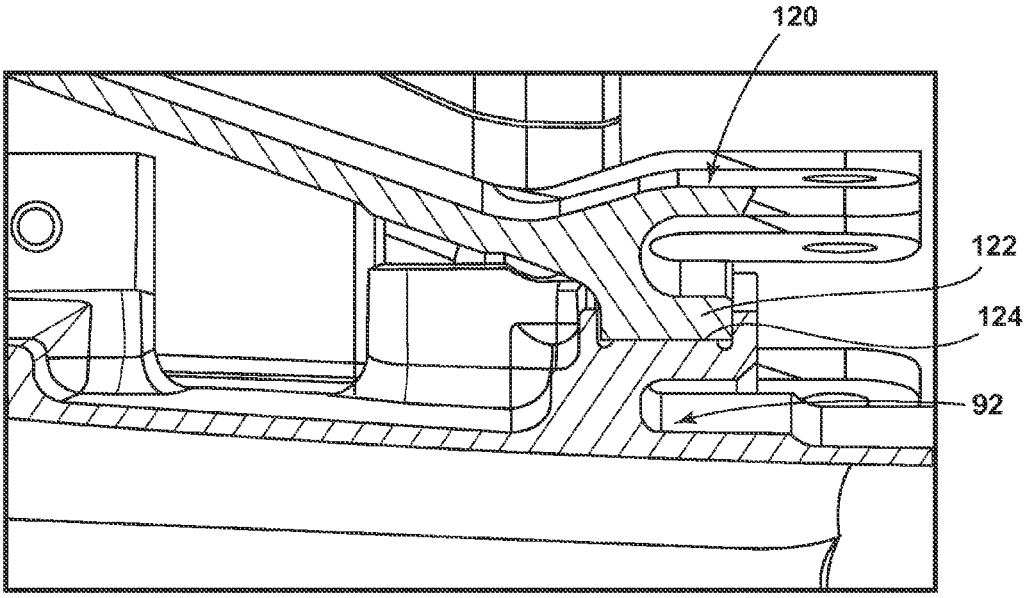
FIG. 12B is a cross-sectional view of the portion of the outer retaining ring inserted into the portion of the fairing assembly.

The combined radial dimension of the vane segment 90 and the inner retaining ring 100 may then be increased by relatively radially moving the vane segment 90 and the inner retaining ring 100. As illustrated the first fairing 92 may be moved radially in the direction of the arrow 126 until a flange 122 of the outer retaining ring 120 is seated within a channel 124 of the first fairing 92. The radial movement seats the first fairing 92 on the outer retaining ring 120 as illustrated in FIG. 12B.

Figure 13:
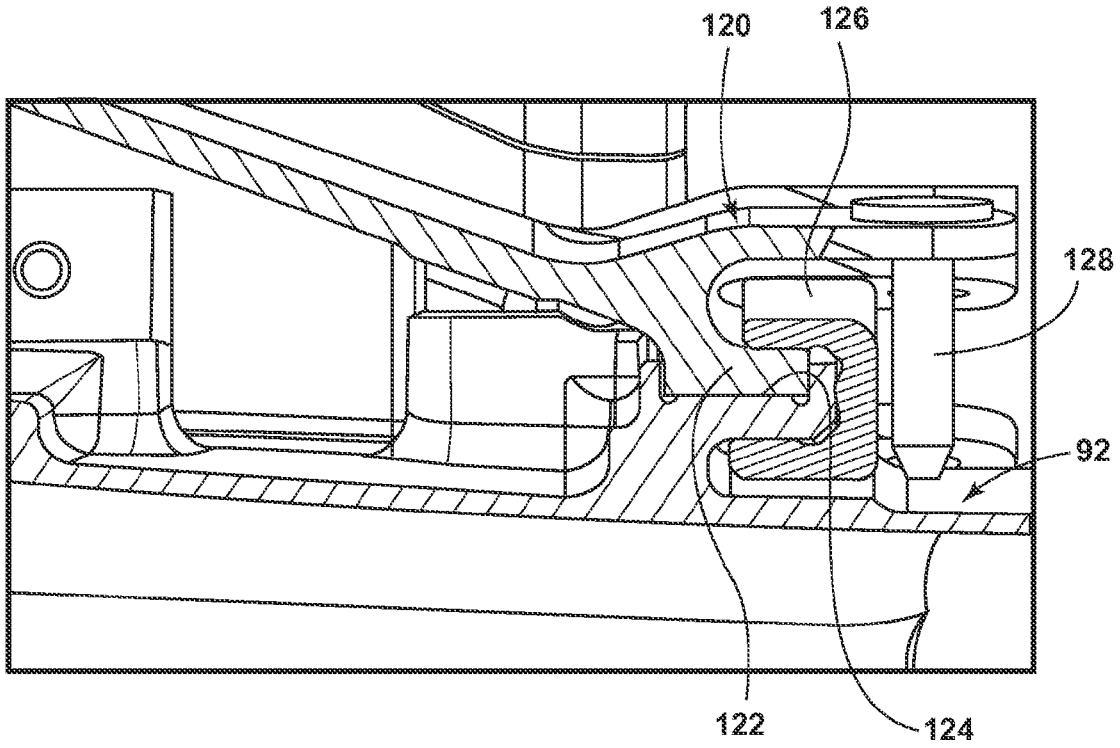
FIG. 13 is cross-sectional view of the portion of the outer retaining ring of FIG. 12 B with a pin and clip installed.

The outer retaining ring 120 may then be attached to the vane segment 90 to fix the radial position of the vane segment 90 relative to the inner and outer retaining rings 100 and 120. The outer retaining ring 120 may be attached to the vane segment 90 in any suitable manner including that a clip 126 may be installed and one or more locking pins 128 may be tack welded into place to retain the clip 126 as illustrated in FIG. 13.

It will be understood that the method of assembly is flexible and the figures illustrated are merely for illustrative purposes. For example, the sequence of steps depicted is for illustrative purposes only, and is not meant to limit the method in any way, as it is understood that the steps may proceed in a different logical order or additional or intervening steps may be included without detracting from embodiments of the invention. By way of non-limiting example, it will be understood that any number of seals may be installed during any suitable portion of the assembly method. Including that a laby seal 130 (FIGS. 2 and 3) may be installed on the exhaust frame 80. Further, the outer retaining ring may be attached to the outer hub and the inner retaining ring may be attached to the inner hub at any suitable time.

Further still, it will be understood that attaching together the vane 90 with the inner retaining ring 100 may include attaching multiple vanes 90 to the inner retaining ring 100 where the multiple vanes 90 are radially spaced about the inner retaining ring 100. Further, all of the above steps may be done for any number of the multiple vanes 90. Thus, positioning the exhaust frame 80 relative to the assembled vane segment 90 and inner retaining ring 100 may include one of the fairings from each of the corresponding vane segments being moved to at least partially encircle one of the struts. In such an instance, reducing the combined radial dimension may include relatively radially moving the vane segments and the inner retaining ring. Further, positioning the outer retaining ring may include positioning the outer retaining ring about all of the vane segments and increasing the combined radial dimension may include radially moving all of the vane segments relative to the inner retaining ring. Further still, attaching the outer retaining ring 120 may include attaching all of the vane segments 90 to the outer retaining ring 120. For each of the fairing pairs, the second fairing of each pair may be positioned about its respective strut such that the fairings completely encircle the strut. Increasing the combined radial dimension may include radially moving the multiple vane segments away from the inner retaining ring toward the outer retaining ring. Finally, attaching the outer retaining ring to the vane segment may include applying a clip to adjacent flanges of the outer retaining ring and the vane segments.

The above described embodiments provide for a variety of benefits including the use of a one piece structural frame or non-segmented hanger, which provides structural integrity, minimizes chording, and enables mounting of the vanes and fairings at their AFT end. A further benefit provided is that there is a reduced the parts count when compared to structural frames that are constructed using a separable hub, which results in decreased manufacturing and maintenance costs. Further still, the staggered split planes of the fairings may result in minimizing their circumferential thickness and aerodynamic blockage, thereby reducing pressure losses. This results in commercial advantages such as increased operating temperatures, increased efficiency, and renders engine product more competitive.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of assembling at least one vane segment having at least one vane formed from a pair of fairings to an exhaust frame having an inner hub and an outer hub, which are connected by at least one strut, the method comprising:

attaching the vane segment with only one of the fairings to an inner retaining ring such that the vane segment may radially move relative to the inner retaining ring;

positioning the exhaust frame relative to the assembled vane segment and the inner retaining ring such that the strut is at least partially encircled by the one of the fairings;

reducing the combined radial dimension of the vane segment and the inner retaining ring by relatively radially moving the vane segment and the inner retaining ring;

positioning an outer retaining ring about the vane segment and the inner retaining ring;

increasing the combined radial dimension of the vane segment and the inner retaining ring by relatively radially moving the vane segment and the inner retaining ring;

attaching the outer retaining ring to the vane segment to fix the radial position of the vane segment relative to the inner and outer retaining rings.

2. The method of claim 1 wherein the attaching together the vane segment with the inner retaining ring comprises attaching together multiple vane segments, radially spaced about the inner retaining ring, to the inner retaining ring.

3. The method of claim 2 wherein more than one of the multiple vane segments comprises a vane formed from a pair of fairings and the positioning the exhaust frame relative to the assembled vane segment and inner retaining ring comprises the one of the fairings from each of the corresponding vane segments at least partially encircling one of the struts.

4. The method of claim 3 wherein reducing the combined radial dimension comprises relatively radially moving the vane segments and the inner retaining ring.

5. The method of claim 4 wherein the positioning the outer retaining ring comprises positioning the outer retaining ring about all of the vane segments.

6. The method of claim 5 wherein increasing the combined radial dimension comprises radially moving all of the vane segments relative to the inner retaining ring.

7. The method of claim 6 wherein attaching the outer retaining ring to the vane segment comprises attaching all of the vane segments to the outer retaining ring.

8. The method of claim 3, further comprising, for each of the fairing pairs, positioning the other of the fairings about the strut such that the fairings completely encircle the strut.

9. The method of claim 1, further comprising positioning the other of the fairings about the strut such that the fairings completely encircle the strut.

10. The method of claim 9 wherein positioning the other of the fairings comprises axially moving the other of the fairings adjacent the one of the fairings and then radially moving the other of the fairings radially outward.

11. The method of claim 1 wherein reducing the combined radial dimension comprises moving a flange on the vane segment radially inwardly into a channel on the inner retaining ring.

12. The method of claim 1 wherein positioning the outer retaining ring about the vane segment comprises axially moving the outer retaining ring over at least a portion of the vane segment.

13. The method of claim 1 wherein the attaching the outer retaining ring to the vane segment comprises applying a clip to adjacent flanges of the outer retaining ring and the vane segment.

14. A method of assembling at least one vane segment having at least one vane formed from a pair of fairings to an exhaust frame having an inner hub and an outer hub, which are connected by at least one strut, the method comprising:

attaching the vane segment with only one of the fairings to an inner retaining ring such that the vane segment may radially move relative to the inner retaining ring;

positioning the exhaust frame relative to the assembled vane segment and the inner retaining ring such that the strut is at least partially encircled by the one of the fairings;

reducing the combined radial dimension of the vane segment and the inner retaining ring by relatively radially moving the vane segment and the inner retaining ring;

axially moving the outer retaining ring over at least a portion of the vane segment;

increasing the combined radial dimension of the vane segment and the inner retaining ring by radially moving the vane segment away from the inner retaining ring toward the outer retaining ring;

attaching the outer retaining ring to the vane segment to fix the radial position of the vane segment relative to the inner and outer retaining rings.

15. A turbine frame for a turbine engine having an axial centerline, the turbine frame comprising:

an inner hub;

an outer hub encircling the inner hub;

a plurality of struts extending between the inner and outer hubs;

at least one vane segment comprising at least first and second fairings mounted to the inner and outer hubs and encircling one of the struts, the first fairing comprising a flange;

an inner retaining ring comprising a radially aligned channel; and a single piece outer retaining ring that is operably coupled to the vane segment to fix a radial position of the vane segment relative to the inner and outer retaining rings;

wherein the flange is inserted into the radially aligned channel of the inner retainer ring, wherein the inserted flange is immobile relative to an axial direction, and wherein the inserted flange radially moves within the radially aligned channel relative to the inner retaining ring until the single piece outer retaining ring is operably coupled to the vane segment.

16. The turbine frame of claim 15, further comprising an alignment pin overlying the channel, wherein the at least one vane segment comprises multiple vane segments and each vane segment encircles one of the struts, and wherein the flange further comprises one or more notches for locating the first fairing in the channel relative to the alignment pin.

17. The turbine frame of claim 16 wherein the at least first and second fairings comprises an aft fairing and a forward fairing that abut along aft and forward join lines.

18. The turbine frame of claim 17 wherein the outer retaining ring comprises an annular hanger frame.

19. The turbine frame of claim 15 wherein the outer retaining ring is operably coupled to the outer hub.

20. The turbine frame of claim 19 wherein the inner retaining ring is operably coupled to the inner hub.

* * * * *